US007178717B1

(12) United States Patent
Lindell

(10) Patent No.: US 7,178,717 B1
(45) Date of Patent: Feb. 20, 2007

(54) MAILBOX SECURITY DEVICE

(76) Inventor: Scott Lindell, 922 Hillgrove La., Auburdale, FL (US) 33823

( * ) Notice: Subject to any disclaimer, the term of this patent is extended or adjusted under 35 U.S.C. 154(b) by 0 days.

(21) Appl. No.: 11/387,580

(22) Filed: Mar. 23, 2006

Related U.S. Application Data

(60) Provisional application No. 60/664,525, filed on Mar. 23, 2005.

(51) Int. Cl.
*B65G 11/04* (2006.01)

(52) U.S. Cl. ..... 232/45; 70/160

(58) Field of Classification Search ..... 232/45, 232/29, 33, 17, 38; D99/29–32; 70/160–162
See application file for complete search history.

(56) References Cited

U.S. PATENT DOCUMENTS 4,181,250 A * 1/1980 Withrow ..... 232/44
4,905,891 A 3/1990 Wildish ..... 232/17
5,407,126 A * 4/1995 Coultas et al. ..... 232/17
5,586,718 A 12/1996 Speece ..... 232/17
5,645,215 A * 7/1997 Marendt et al. ..... 232/17
6,123,257 A * 9/2000 Guidicy ..... 232/17
6,234,387 B1 * 5/2001 Cuthbert et al. ..... 232/29
6,318,628 B1 11/2001 Pangburn ..... 232/17
6,808,108 B1 * 10/2004 Turnbow et al. ..... 232/29
6,929,174 B1 * 8/2005 Ly ..... 232/38
7,070,090 B2 * 7/2006 Ranen ..... 232/45

* cited by examiner

*Primary Examiner*—William L. Miller
(74) *Attorney, Agent, or Firm*—Goldstein Law Offices PC

(57) ABSTRACT

A mailbox security device capable of being mounted within the opening of any standard sized mailbox for securing delivered mail. The mailbox security device includes a frame and a hinged door. The hinged door has an interior surface and a locking mechanism. The locking mechanism has a circular recessed input and key. The interior surface has a latch and spring for locking the locking mechanism.

3 Claims, 2 Drawing Sheets

MAILBOX SECURITY DEVICE

CROSS REFERENCES AND RELATED SUBJECT MATTER

This application is a continuation of provisional patent application Ser. No. 60/664,525 filed in the United States Patent Office on Mar. 23, 2005.

BACKGROUND OF THE INVENTION

The invention relates to a locking mechanism, and more particularly, to a mailbox security device having a hinged locking door and a frame mounted to an opening of any standard sized mailbox for securing delivered mail.

Mailbox security is a key issue for protection against theft of your valuable mail and identity. Many mailboxes are susceptible to thievery because of their isolated and secluded locations. More often than not these susceptible mailboxes are located in rural neighborhoods where homes are spread apart and traffic is reduced. Delivered mail often includes sensitive information, such as social security numbers, bank statements with account numbers, credit card statements, tax information and the like which is advantageous to identity thieves. Letters and packages are stolen from unlocked mailboxes daily and protection of these items is crucial.

U.S. Pat. No. 6,318,628 to Pangburn discloses a single door locking mailbox with deflective cam latching mechanism. U.S. Pat. No. 5,586,718 to Speece discloses a mailbox lock assembly with mail delivery access followed by a key requiring locked status. U.S. Pat. No. 4,905,891 to Wildish discloses a security mailbox with keyed incoming mail removal door and upper general access depository door.

While these units may be suitable for the particular purpose employed, or for general use, they would not be as suitable for the purposes of the present invention as disclosed hereafter.

SUMMARY OF THE INVENTION

It is an object of the invention to provide a convenient means for securing delivered mail. Accordingly, the invention is a mailbox security device having a hinged locking door and a frame for attachment inside a mailbox for securing delivered mail therein.

It is another object of the invention to provide a means for locking both new and already existing mailboxes. Accordingly, the mailbox security device is capable of being mounted within an opening of any standard sized new or existing mailbox.

It is another object of the invention to provide a means for uninterrupted mail delivery while still affording security to a mailbox. Accordingly, the mailbox security device includes a locking mechanism and a hinged door that allows a mailperson to lock the mailbox security device after delivery of mail by simply closing the hinged door, thereby activating the locking mechanism.

It is another object of the invention to provide exclusive security and access to an owner of a mailbox security device. Accordingly, the mailbox security device includes a key and a recessed input for accepting the key which allows security and exclusive mailbox access to the owner.

This invention is a mailbox security device capable of being mounted within the opening of any standard sized mailbox for securing delivered mail. The mailbox security device includes a frame and a hinged door. The hinged door has an interior surface and a locking mechanism. The locking mechanism has a circular recessed input and key. The interior surface has a latch and spring for locking the locking mechanism.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
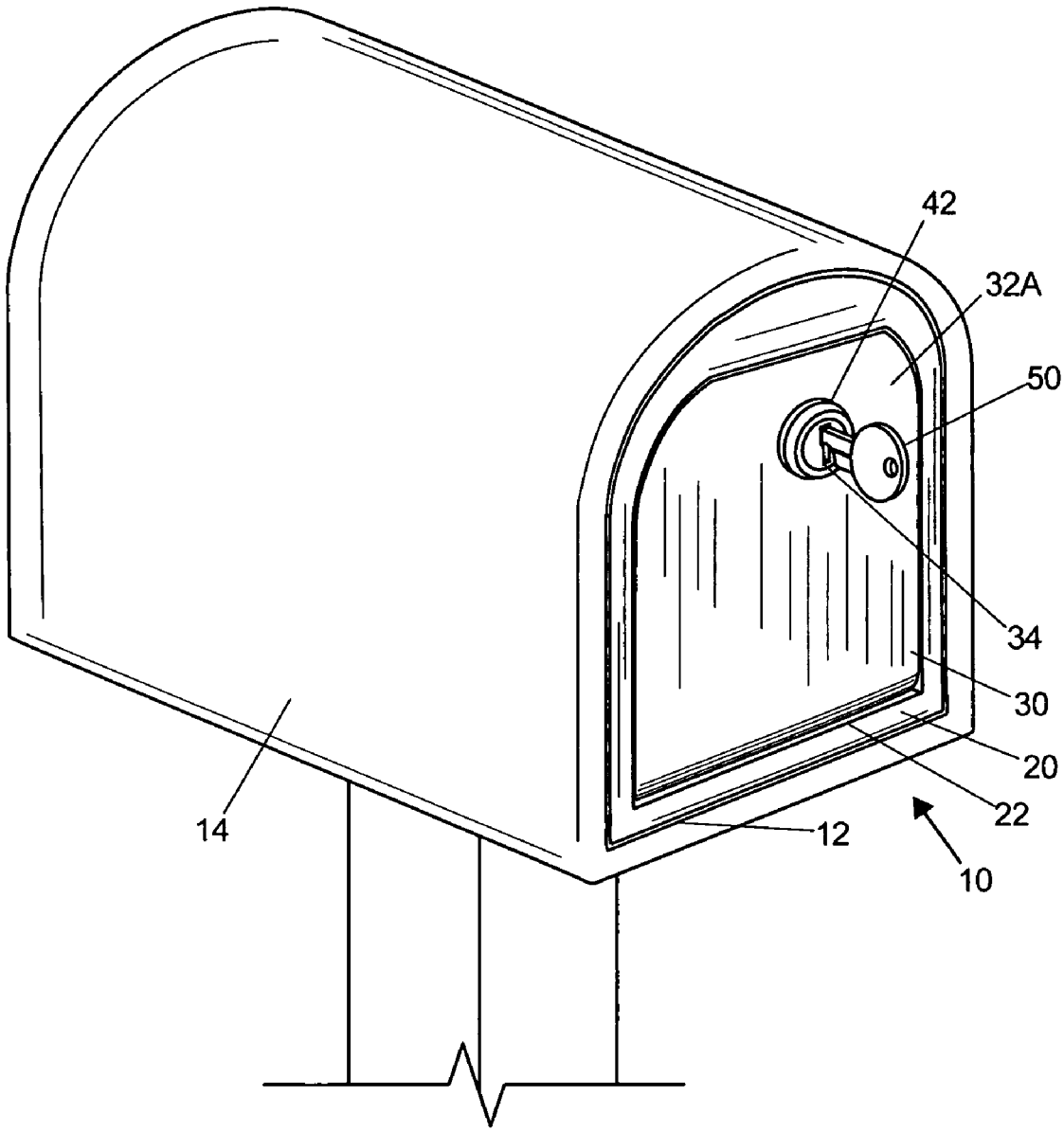
FIG. 1 is a diagrammatic perspective view of a mailbox security device of the present invention, having a frame and a hinged door in a closed position, wherein the hinged door includes a locking mechanism having a recessed input, a key and a knob.

FIG. 1 illustrates a mailbox security device 10 for securing delivered mail capable of being mounted within an opening 12 of a standard sized mailbox 14.

The mailbox security device 10 includes a frame 20. The frame 20 is substantially oval in shape with a flat base 22. The frame 20 mirrors the opening 12 of a standard mailbox 14, although slightly smaller and is mountable within the opening of the standard mailbox 14.

The frame 20 of the mailbox security device 10 houses a hinged door 30. The hinged door 30 attaches to the flat base 22 of the frame 20. The hinged door 30 has a closed position 32A and an open position 32B, shown in FIG. 2. When in the closed position 32A, the hinged door 30 fits tightly and securely into the frame 20. The hinged door 30 has a locking mechanism 42 that includes a recessed input 34 and a key 50 for unlocking the mailbox security device 10.

Figure 2:
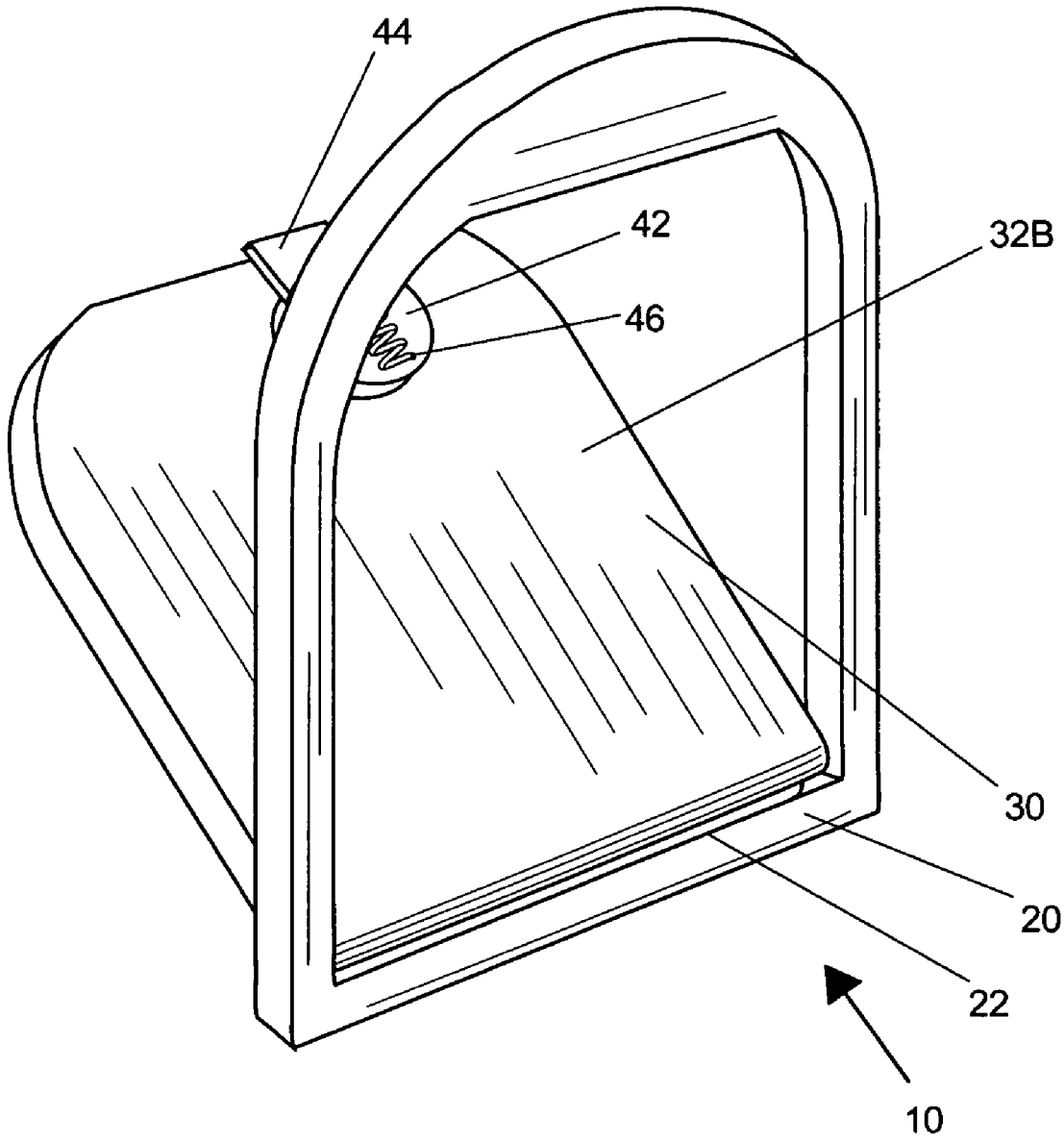
FIG. 2 is a diagrammatic perspective view of a mailbox security device of the present invention, wherein the hinged door is shown in the open position and includes an interior surface having a latch and spring for locking and unlocking said hinged door.

FIG. 2 illustrates a mailbox security device 10 in the open position 32B. When the mailbox security device is in the open position 32B, the hinged door 30 rotates downwardly, remaining connected to the flat base 22 of the frame 20. The hinged door 30 has an interior surface 40. The interior surface 40 contains a latch 44 attached to a spring 46. The recessed input 34 and key 50, shown in FIG. 1 couple with the locking mechanism 42 to unlock the mailbox security device 10. When the hinged door 30 is in the closed position, shown in FIG. 1, the spring 46 releases, causing the latch 44 to extend upwardly as shown and to engage the frame 20. Simply closing the hinged door 30 activates the locking mechanism 42. By inserting the key 50 into the recessed input 34 the spring 46 compresses and the latch 44 releases, allowing the hinged door 30 to open. The key 50 gives security and exclusive mailbox access to an owner.

In use, the mailbox security device 10 is shown in the open position 32B having the latch 44 and spring 46 disengaged. Automatic locking occurs when the hinged door 30 is pushed into the closed position 32A. Once in the closed position 32A, the hinged door 30 can be opened by placing the key 50 into the recessed input 34 and turning the key 50.

When the key 50 is turned, the spring 46 is compressed, releasing the latch 44 from the frame 20 of the mailbox security device 10 thereby unlocking the hinged door 30.

In conclusion, herein is presented a mailbox security device for securing delivered mail capable of being mounted on within an opening of any standard sized mailbox. The invention is illustrated by example in the drawing figures, and throughout the written description. It should be understood that numerous variations are possible, while adhering to the inventive concept. Such variations are contemplated as being a part of the present invention.

What is claimed is:

1. A mailbox security device capable of being mounted within an opening of a mailbox, comprising:

a frame substantially oval in shape having a flat base, the frame mirroring the opening of the mailbox and mountable thereon; and a hinged door housed in the frame attaches to the flat base of the frame, having an open and closed position, said hinged door having an interior surface and a locking mechanism having a circular recessed input and key, said interior surface having a latch attached to a spring, said latch extends upwardly engaging the frame when the door is in the closed position and releasing when the key is inserted into the recessed input.

2. A mailbox security device capable of being mounted within an opening of a mailbox, comprising:

a frame substantially oval in shape having a flat base, the frame mirroring the opening of the mailbox and mountable thereon; and a hinged door housed in the frame attaches to the flat base of the frame, having an open and closed position, said hinged door having an interior surface and a locking mechanism having a circular recessed input and key.

3. The mailbox security device of claim 2, wherein the interior surface has a latch attached to a spring, said latch extends upwardly to engage the frame when the hinged door is in the closed position and releases when the key is inserted into the recessed input.

* * * * *